343-909
7/21/87 XR 4,682,180

United States Patent [19]
Gans

[11] Patent Number: 4,682,180
[45] Date of Patent: Jul. 21, 1987

[54] MULTIDIRECTIONAL FEED AND FLUSH-MOUNTED SURFACE WAVE ANTENNA

[75] Inventor: Michael J. Gans, Monmouth Beach, N.J.

[73] Assignee: American Telephone and Telegraph Company AT&T Bell Laboratories, Murray Hill, N.J.

[21] Appl. No.: 779,108

[22] Filed: Sep. 23, 1985

[51] Int. Cl.[4] ..... H01Q 13/18; H01Q 15/10
[52] U.S. Cl. ..... 343/769; 343/873; 343/783; 343/785; 343/909
[58] Field of Search ..... 343/767–769, 343/771, 785, 755, 705, 706, 708, 710, 711, 783, 786, 873, 909, 772, 773, 775, 746

[56] References Cited

U.S. PATENT DOCUMENTS

| | | | |
|---|---|---|---|
| 2,637,814 | 5/1953 | Johnson | 343/769 |
| 2,644,090 | 6/1953 | Dorne . | |
| 2,867,803 | 1/1959 | Kerley | 343/767 X |
| 3,631,500 | 12/1971 | Itoh | 343/725 |
| 3,805,266 | 4/1974 | Fletcher et al. | 343/708 |
| 4,089,817 | 5/1978 | Kirkendall | 343/713 |
| 4,130,822 | 12/1978 | Conroy | 343/700 |
| 4,229,744 | 10/1980 | Luedtke | 343/769 |
| 4,369,447 | 1/1983 | Edney | 343/769 |
| 4,395,713 | 7/1983 | Nelson et al. | 343/713 |
| 4,443,802 | 4/1984 | Mayes | 343/729 |
| 4,443,804 | 4/1984 | Smith | 343/769 |

OTHER PUBLICATIONS

Kim et al., G-AP International Symposium, Aug. 22–24, 1973, Boulder, Colo, pp. 164–166.
Gregorwich, IEEE Trans. Comm., vol. AP-22, No. 1, Jan. 1974, pp. 71–74.
Munson, IEEE Trans. Comm., vol. AP-22, No. 1, Jan. 1974, pp. 74–78.
Bogner, IEEE Trans. Comm., vol. AP-22, No. 1, Jan. 1974, pp. 78–81.
Weeks, Antenna Engineering, McGraw-Hill, pp. 230–235.
Jasik, Antenna Engineering Handbook, McGraw-Hill, 1st Ed., pp. 8-8 to 8-10 and 27-32 to 27-36.
Bhattacharyya et al., IEEE Proc., vol. 132, Pt. H, No. 2, Apr. 1985, pp. 93–98.
Jakes, Jr., Microwave Mobile Comm., John Wiley & Sons, 1974, pp. 401–402.

*Primary Examiner*—Marvin L. Nussbaum
*Attorney, Agent, or Firm*—Erwin W. Pfeifle

[57] ABSTRACT

The present invention relates to a multidirectional feed which can be used by itself or preferably incorporated within a surface wave structure to form a flush-mounted antenna on, for example, a mobile unit. The feed arrangement comprises a ground plane including an annular cavity with a smaller annular slot. The annular slot is connected by multiple, spaced-apart, leads to an associated transceiver. The annular cavity is also formed to prevent both a shorting of the radio waves therein and the radio waves from propagating away from the cavity in a direction opposite the slot. A surface wave structure is disposed preferably with the feed centrally mounted and can comprise any suitable structure including annular corrugations and/or a dielectric layer to provide a flush-mounted antenna arrangement which provides radiation in azimuth in all directions with moderate elevation gain.

10 Claims, 8 Drawing Figures

MULTIDIRECTIONAL FEED AND FLUSH-MOUNTED SURFACE WAVE ANTENNA

TECHNICAL FIELD

The present invention relates to a multidirectional feed which can be used by itself or incorporated within a surface-wave structure to form for example, a flush-mounted antenna on a mobile unit. More particularly, the present invention relates to a multidirectional antenna feed comprising an annular slot, and associated cavity, in a ground plane which slot area is fed by multiple, spaced-apart, connections from, for example, a coaxial line. The feed further comprises a cavity designed for both shielding radio waves excited in the annular slot and cavity from propagating in a direction opposite an aperture of the slot and preventing a shorting of the radio waves. The feed generates a multidirectional radio wave that can be launched into a surface wave antenna structure which can be flush-mounted in the outer surface of a mobile unit to provide uniform radiation in azimuth in all directions with moderate elevation gain. The multiple connections can further be individually fed with varying amplitudes and phases to provide multi-lobed azimuth radiation for diversity operation.

DESCRIPTION OF THE PRIOR ART

Antennas for vehicles or aircraft have been provided in various configurations. The most general one seen today for vehicles is the whip antenna as disclosed, for example, in U.S. Pat. No. 4,089,817 issued to D. Kirkendall on May 16, 1978.

Slot antennas have also been used for mobile radio communication and can be found comprising many different forms. In U.S. Pat. No. 2,644,090 issued to A. Dorne on June 30, 1953, a recessed slot antenna for an aircraft is disclosed which comprises either an annular slot in a conducting surface or an annular slot arranged in four arcuate slot sections in a conducting surface separated by conducting strips extending transversely across the slot. A shallow cavity is formed below the conducting surface by outwardly extending walls and the cavity is centrally fed by a coaxial line.

U.S. Pat. No. 3,631,500 issued to K. Itoh on Dec. 28, 1971, discloses a mobile radio slot antenna comprising a slot in a conducting plate and an electric current antenna normal to the plate. The signals from each antenna are independently coupled to separate square law detectors and combined to provide the output signal.

Another mobile radio slot antenna is disclosed in U.S. Pat. No. 4,443,802 issued to P. Mayes on Apr. 17, 1984, wherein a hybrid slot antenna comprises a pair of closely spaced parallel ground planes and a radiating element which is a composite aperture formed into the upper ground plane. One portion of the radiating element is a long narrow slot and the other portion is an annular slot coincident with the narrow slot. Electromagnetic energy is conveyed to and from the slots by means of a feed parallel to, and sandwiched between, the two ground planes.

Another annular slot antenna arrangement is disclosed in *Antenna Engineering Handbook* by H. Jasik, First Edition, McGraw-Hill in FIG. 27–44 at page 27–36. There the antenna comprises an inner parasitic annular slot and an outer driven annular slot. The parasitic annular slot and associated cavity is coupled to the radiating aperture through a mutual impedance between the two slots. The cavities associated with the outer driven annular slot are shaped to provide an equivalent parallel tuned circuit and provide a low characteristic impedance to the centrally fed coaxial line.

The problem in the prior art is to provide a mobile antenna which provides all of the electromagnetic performance requirements of a mobile telephone antenna while remaining conformal to the surface of a vehicle. Such antenna should provide a uniform azimuthal pattern and elevation gain in the horizontal direction with a wide-band efficient feed that is simple and inexpensive to implement and is less susceptible to damage or vandalism and burglary than prior art mobile antennas.

SUMMARY OF THE INVENTION

The foregoing problem has been solved in accordance with the present invention which relates to a multidirectional feed for an antenna which can be flush-mounted with the outer surface of a mobile unit. More particularly, the present invention relates to a multidirectional annular slot antenna feed comprising an annular slot and an associated cavity in a ground plane, where the slot is fed by multiple, spaced apart, connections from, for example, one or more coaxial lines to excite radio waves in the annular slot and associated cavity. The cavity provides for both shielding the radio waves from propagating in a direction opposite to the aperture of the annular slot and preventing a shorting of the radio waves. The multiple connections can further be individually fed with varying amplitudes and phases to provide multi-lobed azimuth radiation for diversity operation.

It is an aspect of the present invention to provide a feed that generates a multidirectional radio wave that can be launched into a surface-wave antenna structure to provide uniform or multi-lobed radiation in azimuth with moderate elevation gain. The feed comprises an annular slot, and an associated cavity, connected to an associated transceiver by, for example, a coaxial line coupled to multiple, spaced-apart, points around the slot. The cavity has its inner wall formed from a conductive material to shield the radio waves excited in the slot from propagating in a direction opposite the aperture of the slot and a width to prevent a shorting of the radio waves. The feed can be mounted by itself or within a surface wave structure in the outer surface of a mobile unit. The optional surface wave structure can comprise any combination of corrugations and a layer of dielectric material. If the feed and optional surface-wave structure are disposed in a slight depression in the outer surface of the mobile unit, a dielectric layer, forming part of the surface wave structure, can fill in the depression to conform with the outer surface of the mobile unit.

Other and further aspects of the present invention will become apparent during the course of the following description and by reference to the accompanying drawings.

BRIEF DESCRIPTION OF THE DRAWINGS

Referring now to the drawings in which like numerals represent like parts in the several views.

DETAILED DESCRIPTION

Figure 1:
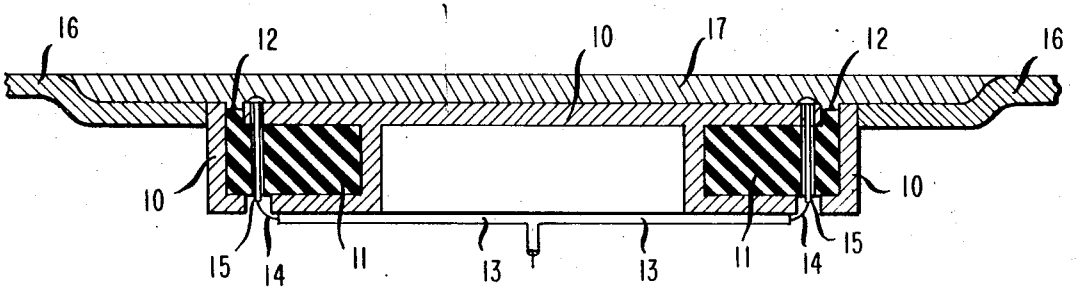
FIG. 1 is a cross-sectional side view of an annular slot antenna feed illustrating the general concept of the present feed arrangement.

FIG. 1 is a cross-sectional side view of a basic version of a feed and surface wave antenna arrangement in accordance with the present invention to aid in providing an understanding of the concepts involved. In FIG. 1, a ground plane 10 of conductive material is formed to include an annular cavity 11, which is filled with a dielectric material, that opens into an annular slot 12. An input feed 13, as, for example, the coaxial line shown in FIG. 1, has the shield thereof grounded to ground plane 10 while the center conductor thereof is coupled by wires 14 to multiple points around annular slot 12 through apertures 15 in both ground plane 10 and the dielectric material in cavity 11. It is preferred that the multiple points of connection to annular slot 12 be three or more in number if it is desired to ensure uniform radiation in azimuth in all directions from the feed. It is to be understood that an increase in equally-spaced connections around annular slot 12 provides a more uniform radiation in azimuth in all directions, and that the path lengths of feed line 13 to the multiple point connections around annular slot 12 should preferably be of equal length for uniform radiation.

The feed arrangement can be disposed in a depression in the outer surface 16 of a mobile unit and the depression filled with a dielectric material 17 to form a surface wave propagating device which results in a flush-mounted antenna arrangement. Annular cavity 11 preferably should have (1) its inner surface formed with a conductive layer to prevent radio waves excited in annular slot 12, and in turn cavity 11, from propagating in a direction away from annular slot 12, and (2) a width to prevent shorting of the radio waves in cavity 11. More particularly, the width of cavity 11 should approximate a quarter-wavelength so that cavity 11 will appear close to an open circuit. Primarily, the capacitive reactance provided by annular slot 12 will be then balanced out by the inductive reactance provided by the approximate quarter-wavelength width of cavity 11 and thereby prevent a shorting of the radio waves in cavity 11. Additionally, annular slot 12 preferably should include a spacing of approximately one-tenth wavelength or less, but it should be understood that such slot width is not a definite limitation and could be increased somewhat for purposes of practicality and still provide proper operation.

Figure 8:
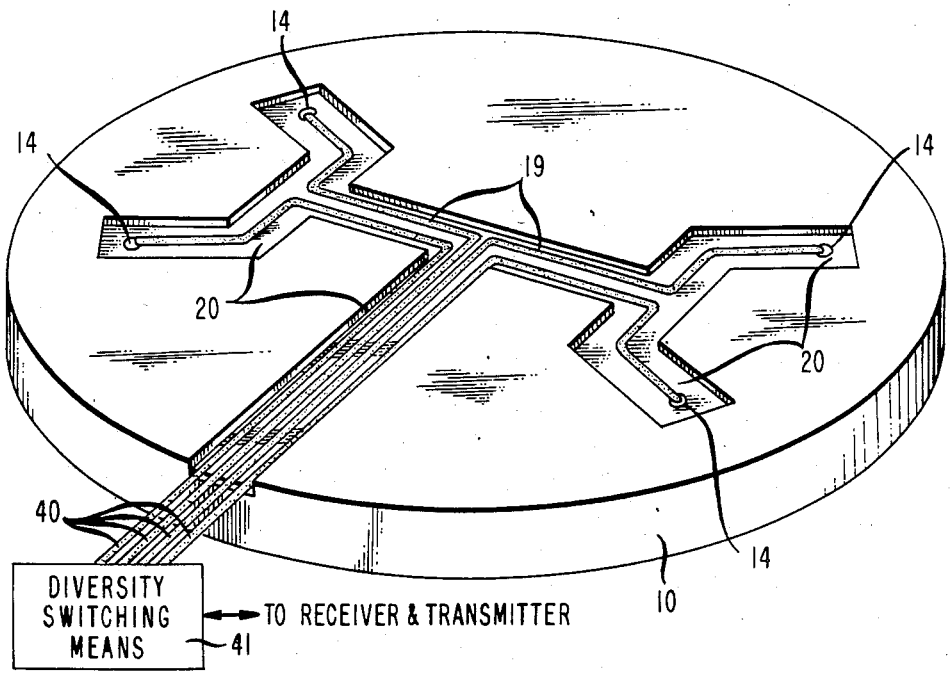
FIG. 8 is a partial view in perspective of the underside of the feed arrangement shown in FIG. 3 with individual leads to each point of launch or reception around the annular cavity and diversity switching means.

In operation, an r-f signal is coupled through feed line 13 to its multiple connections around and adjacent annular slot 12, or the various connections could be fed independently as shown in FIG. 8. In this regard see, for example, the article "Generalized Transmission Line Model for Microstrip Patches" by A. K. Bhattacharyya et al. in *IEE Proceedings*, Vol. 132, Pt. H, No. 2, April 1985, at pp. 93-98. The r-f signal is excited in annular slot 12 and cavity 11. The cavity includes an inner wall that is formed from a conductive material and, therefore, prevents the excited radio wave from propagating past the bottom of the cavity. The cavity also has a width to prevent the radio wave excited in cavity from being shorted therein. As a result, the radio wave is launched from annular slot 12. A surface wave device 17 can be provided to launch the radio wave with uniform or multi-lobed radiation in azimuth and with moderate elevation gain.

Figure 2:
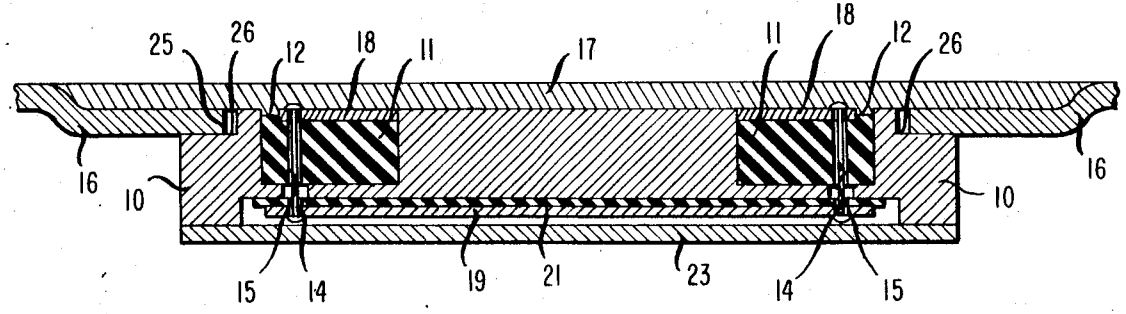
FIG. 2 is a cross-sectional view of a preferred embodiment of an annular slot antenna feed in accordance with the present invention, which embodiment is similar to the arrangement of FIG. 1, including a surface wave structure and is flush-mounted with the surface of a mobile unit.

FIG. 2 illustrates a cross-sectional side view of a preferred embodiment of the present feed arrangement, which is similar to the arrangement of FIG. 1. In FIG. 2 ground plane 10 is provided with an annular channel therein forming cavity 11. Cavity 11, or the channel, is filled with a ring of dielectric material. A layer 18 of conductive material is formed, or disposed, over the ring of dielectric material by any well-known technique. It is to be understood that conductive layer 18 can comprise any conductive material, including that of ground plane 10, and can be formed, for example, by disposing a ring of the conductive material over the dielectric material in cavity 11, with the inner edge of layer 18 making electrical contact with ground plane 10. Alternatively, conductive layer 18 could be formed on both the dielectric material in cavity 11 and all or part of the central upper surface of ground plane 10 surrounded by annular cavity 11. A portion of layer 18 can then be removed, as required, by machining or etching techniques to form annular slot 12 adjacent the outer rim of cavity 11.

Instead of a coaxial cable as shown in FIG. 1, feed 13 is shown in FIG. 2 as comprising an appropriately dimensioned stripline 19 or other layer of conductive material disposed in a groove 20 in ground plane 10. Stripline 19 is shown insulated from ground plane 10 by an insulating layer 21. Stripline 19 is further shown as connected to conducting layer 18 by wires 14 or other means (e.g., plated through hole, etc.) passing through apertures 15 at multiple locations around annular slot 12. A cover 23 of preferably conductive material, similar to ground plane 10, is disposed to cover (1) the striplines 19 and associated grooves 20 in ground plane 10 and (2) the bottom of ground plane 10.

Ground plane 10 also can include an annular recess 26 around its upper outer edge to permit mounting of the feed arrangement in an aperture 25 in the outer surface 16 of a mobile unit. A layer 17 of dielectric material can then be disposed over the ground plane 10 and the adjacent outer surface 16 of the mobile unit mounting the feed to form a surface wave structure which can be formed flush with the outer surface 16 of the mobile unit. It is to be understood that the feed arrangement can be permanently mounted to the outer surface 16 of the mobile unit at recess 26 with, for example, screws or tack welds (not shown). Similarly, cover 23 can be joined to ground plane 10 by means of, for example, screws or tack welds (not shown).

Figure 3:
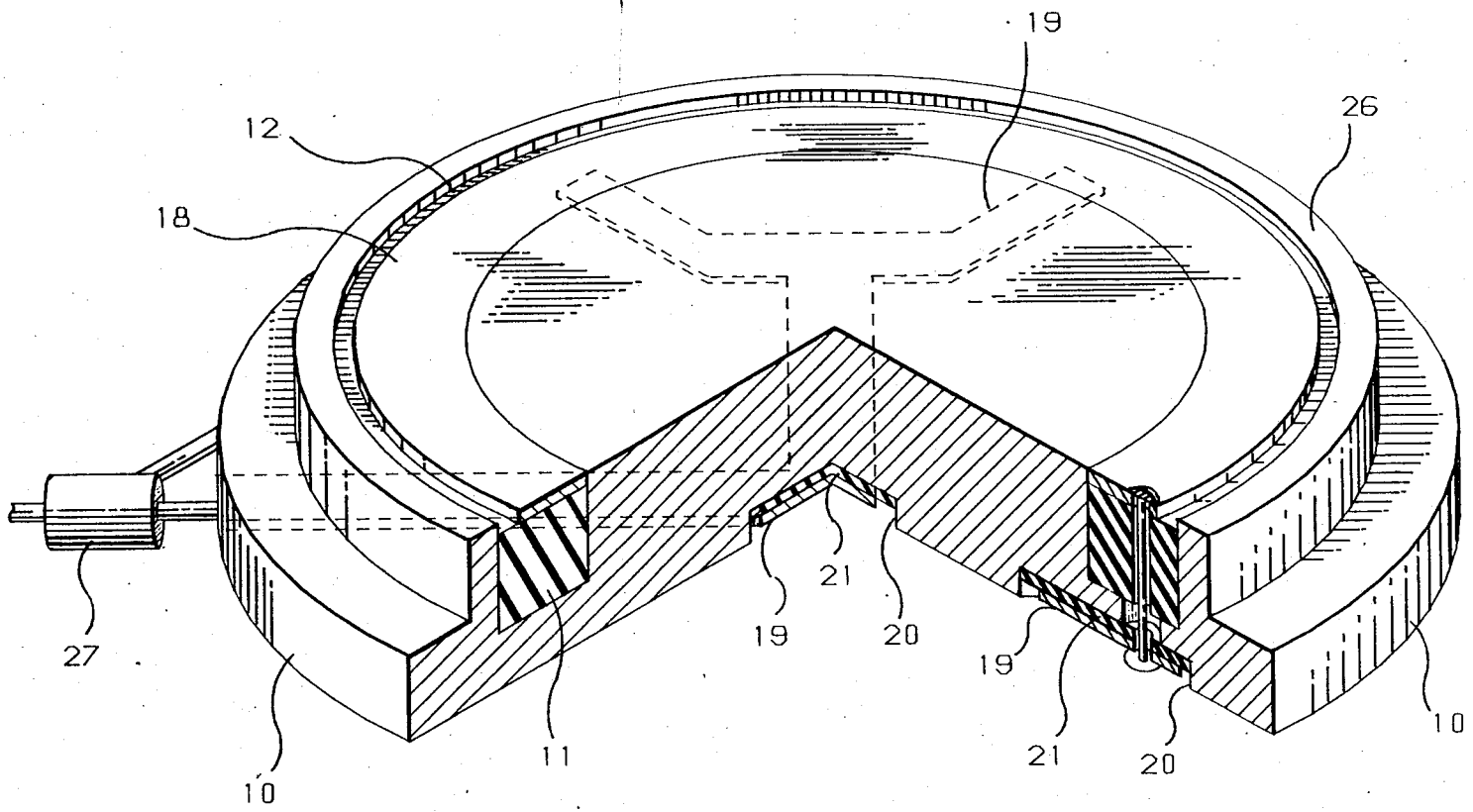
FIG. 3 is a partial cross-sectional view in perspective of the feed arrangement shown in FIG. 2.

FIG. 3 is a partial cross-sectional top and side view in perspective of the feed arrangement of FIG. 2, without cover 23, to provide a clearer perspective of the feed arrangement. As can be seen from this view, and that of FIG. 4 which is a bottom and side view of the feed arrangement of FIG. 3, stripline feed 19 comprises a main feed which is connected to a transceiver via a coaxial line 27. The main feed then branches off into two sections at the middle of ground plane 10 and then subdivides in each branch to provide four equally spaced connections via wires 14 to annular slot 12. Other and similar arrangements could be provided for other numbers of multiple connections to annular slot 12 which preferably should be three or more connections if it is desired to assure a uniform launching of a radio wave in all directions from annular slot 12.

Figure 4:
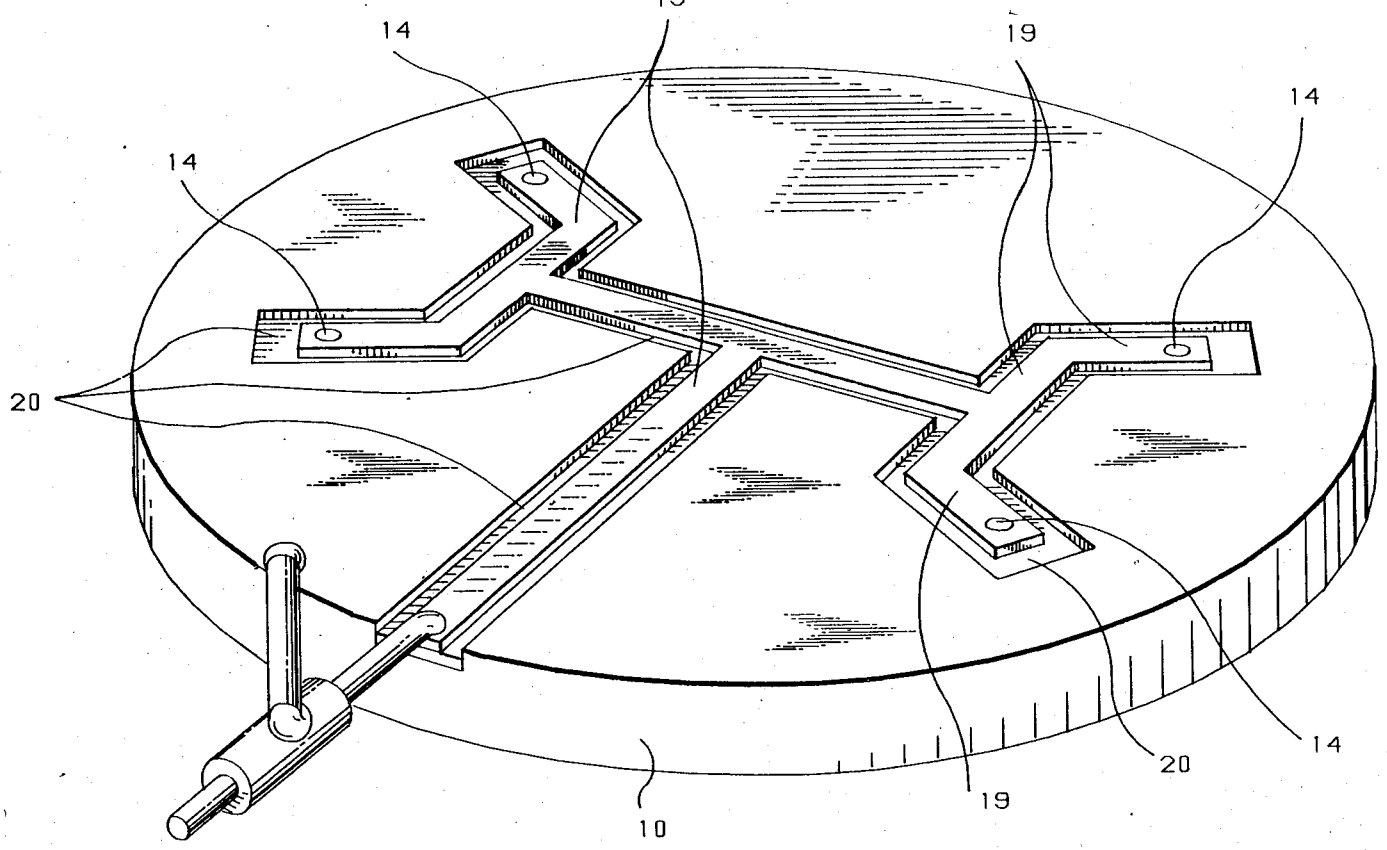
FIG. 4 is a partial view in perspective of the underside of the feed arrangement shown in FIG. 3.
Figure 5:
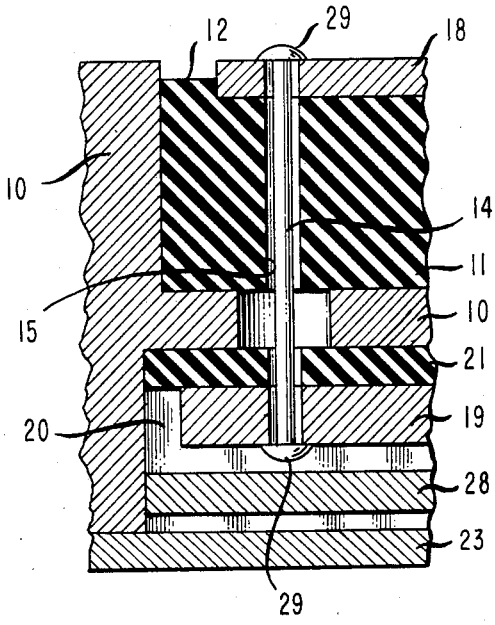
FIG. 5 is a cross-sectional side view of the interconnection arrangement between the stripline and conducting layer forming the annular slot of the arrangement of FIGS. 2-4.

FIG. 5 shows an enlarged cross-sectional view of the feed arrangement of FIGS. 2–4 in the area of annular slot 12, depicting the interconnection of a stripline feed 19 through insulating layer 21, ground plane 10, and the dielectric material in cavity 11 to the layer 18 with a wire 14. In FIG. 5, the wire 14 is electrically connected to layer 18 and stripline 19 by a solder connection 29. Also shown is a layer of insulating material 28 which is disposed in groove 20 between stripline 19 and cover 23 to prevent a possible short therebetween.

Figure 6:
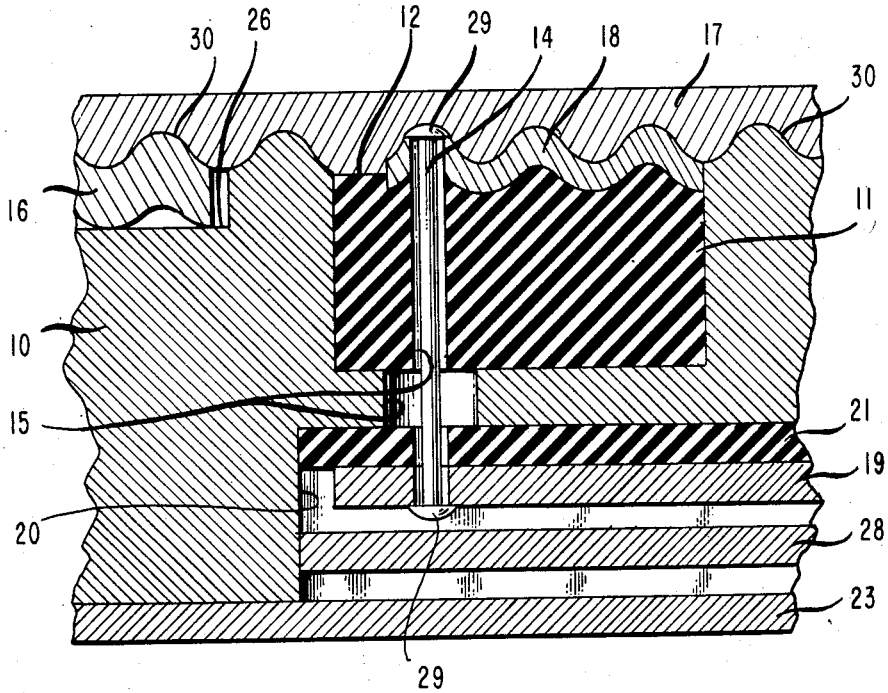
FIG. 6 is a partial cross-sectional side view of the arrangement of FIG. 2 which includes a corrugated surface wave structure.

FIG. 6 illustrates an enlarged partial cross sectional side view of the arrangement of FIGS. 2 and 5 to provide a corrugated surface wave device adjacent annular slot 12 in the upper surface of ground plane 10 and the outer surface 16 of the mobile unit. To provide such corrugated surface wave device, the upper surface of ground plane 10 and the dielectric material in cavity 11 is formed with corrugations 30 of a predetermined width and depth. In a similar manner, the outer surface of the mobile unit, in the vicinity of the feed, is also formed with corrugations 30 of said predetermined width and depth to permit a surface wave of the r-f transmitted or received signal to propagate therealong to and from annular slot 12. Corrugations 30 would preferably be annular in nature and progress outwards from the center of the feed and into the outer surface 16 of the mobile unit mounting the feed. The annular progression of corrugations 30 permit a surface wave to propagate uniformly out from annular slot 12 in azimuth in all directions and similarly permit the feed to receive radio waves from all directions in azimuth. As is well-known in the art, the depth of corrugations 30 should approximate a quarter wavelength. The shape of the corrugations 30 can comprise any shape as, for example, rectangular, etc. Depending on the shape, it may also be advantageous to add a layer 17 of dielectric material to fill in corrugations 30, as shown in FIG. 6, to (a) provide a more efficient surface wave device, (b) allow the use of shallow corrugations, and (c) provide a smooth contour with the outer surface 16 of the mobile unit especially if, for example, the feed arrangement of FIG. 2 is mounted in a depression in the outer surface 16 of the mobile unit.

Figure 7:
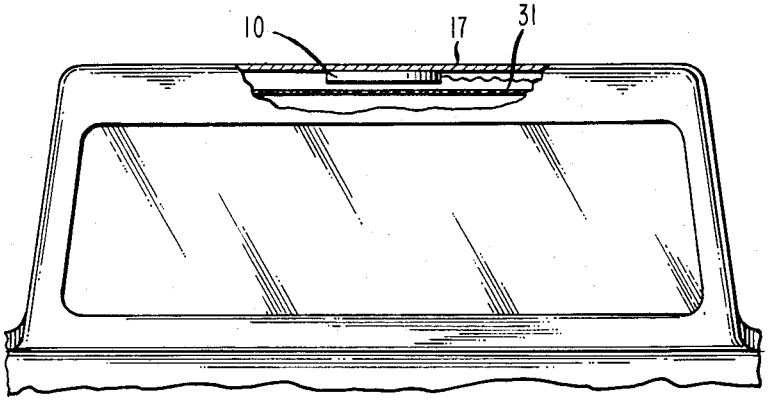
FIG. 7 illustrates the mounting of the present feed arrangement in the roof of a vehicle.

FIG. 7 illustrates a typical roof mounting arrangement of the present feed and antenna arrangement in a vehicle. There the feed arrangement 10 of FIGS. 2–6 is mounted in a depression in the roof, and a corrugated and/or dielectric layer surface wave device 17 fills in the depression to provide a flush-mounted antenna arrangement. A coaxial cable 27 to the feed arrangement can be run to the associated transceiver in the mobile unit between the roof (outer surface 16) and a head-liner 31 of the vehicle. As shown in FIG. 8, for diversity operation, the multiple connections around annular cavity 11 can be individually fed via leads 40 to each of the points about annular cavity 11 to produce multi-lobe radiation which matches a channel radiation pattern appropriate of the local environment. More particularly, the amplitudes and phases of the signal for each of the multiple points about annular cavity 11 should be the complex conjugate of the transmission coefficient from that port or point to the remote base station for adaptive maximal ratio diversity operation. For switched diversity operation, the portable receiver or transmitter is sequentially switched via switching means 41 between each of the multiple points or ports about annular cavity 11 until the strongest signal is obtained. Such switched diversity operation is well known in the art as shown and described in, for example, the book *Microwave Mobile Communications,* by W. C. Jakes, J. Wiley and Sons, 1974, at pp. 401–402.

It is to be understood that the abovedescribed embodiments are simply illustrative of the principles of the invention. Various other modifications and changes may be made by those skilled in the art which will embody the principles of the invention and fall within the spirit and scope thereof. For example, ground plane 10, and cover 23, could be fabricated from a light-weight dielectric material (e.g., foam, etc.) and the complete outer surface thereof, including cavity 11, formed with a thin layer of conductive material to reduce the weight of the overall antenna feed arrangement. With such fabrication technique, one could avoid forming a conductive layer both within grooves 20 associated with stripline feeds 19 and on cover 23 either totally or just adjacent grooves 20. Such latter arrangement would then not require the insulation layers 21 and 28 on either side of striplines 19.

What is claimed is:

1. A multidirectional antenna feed arrangement comprising:

a ground plane including an annular cavity within the ground plane comprising a width between inner walls which approximates a quarter-wavelength of a radio wave to be launched or received by the antenna feed arrangement to prevent a shorting of the radio wave within the cavity, and an annular slot forming an opening from the cavity in a first major surface of the ground plane, the annular slot including a predetermined width which produces a predetermined capacitive reactance that is substantially balanced by an inductive reactance produced by the approximate quarter-wavelength width of the cavity in the ground plane; and means, disposed at multiple spaced-apart locations around a first edge of the annular slot, and capable of simultaneously delivering or receiving a radio frequency message signal to or from multiple locations around the annular slot for exciting or extracting a corresponding radio wave in the cavity and slot and launching or receiving said radio wave from the slot.

2. A multidirectional antenna feed arrangement according to claim 1 wherein said delivering means is capable of simultaneously delivering a radio message signal to each of the multiple locations around the annular slot via separate leads with an amplitude and phase which is a complex conjugate of a separate transmission coefficient associated with each multiple location for adaptive maximal ratio diversity operation.

3. A multidirectional antenna feed arrangement according to claim 1 wherein said delivering means comprises a switching means connected to each multiple location around the annular slot via separate leads, said switching means being responsive to control signals from a remote base station for switching signals to be transmitted between each of the multiple locations to provide the strongest signal to the base station, and for selecting which of the multiple locations provides the strongest received signal from the base station.

4. A multidirectional antenna feed arrangement according to claim 1 wherein the annular slot has a width which substantially does not exceed a tenth-wavelength of the radio wave to be launched or received by the feed arrangement.

5. A multidirectional antenna feed arrangement according to claim 1, 2, or 3 wherein an outer surface of the ground plane, wherein the annular slot is disposed, comprises annular corrugations for forming a surface wave arrangement for radio waves launched or received by the annular slot.

6. A multidirectional antenna feed arrangement according to claim 5 wherein the annular corrugations are filled with a dielectric material to form a smooth outer surface of the feed arrangement.

7. A multidirectional antenna feed arrangement according to claim 5 wherein the feed arrangement is mounted in an aperture in an outer surface of a surface-wave antenna, and said outer surface of the antenna includes corrugations which continue the annular corrugations in the outer surface of the ground plane.

8. A multidirectional antenna feed arrangement according to claim 7 wherein the annular corrugations in the outer surface of the ground plane and the outer surface of the surface-wave antenna are filled in with a dielectric material to form a smooth outer surface.

9. A multidirectional antenna feed arrangement according to claim 1, 2, or 3 wherein the outer surface of the ground plane wherein the slot is disposed is covered with a layer of dielectric material to form a surface-wave launching arrangement for radio waves launched from the annular slot.

10. A multidirectional antenna feed arrangement according to claim 9 wherein the feed arrangement is mounted in an aperture in an outer surface of a surface wave antenna, and the outer surface of the ground plane and the outer surface of the surface-wave antenna include a layer of dielectric material thereon forming a smooth outer surface.

* * * * *